US010267135B2

(12) United States Patent
Echenagucia Cioppa

(10) Patent No.: US 10,267,135 B2
(45) Date of Patent: Apr. 23, 2019

(54) OIL PRODUCTION WELL GAS SEPARATOR SYSTEM USING PROGRESSIVE PERFORATIONS

(71) Applicant: Gasport International Company, Caracas (VE)

(72) Inventor: Jorge Echenagucia Cioppa, Caracas (VE)

(73) Assignee: GASPORT INTERNATIONAL COMPANY, Caracas (VE)

( * ) Notice: Subject to any disclaimer, the term of this patent is extended or adjusted under 35 U.S.C. 154(b) by 205 days.

(21) Appl. No.: 15/214,424

(22) Filed: Jul. 19, 2016

(65) Prior Publication Data

US 2018/0023378 A1 Jan. 25, 2018

(51) Int. Cl.

| | |
|---|---|
| ***E21B 43/34*** | (2006.01) |
| ***E21B 43/38*** | (2006.01) |
| ***E21B 43/12*** | (2006.01) |

(52) U.S. Cl.
CPC ..... *E21B 43/38* (2013.01); *E21B 43/121* (2013.01)

(58) Field of Classification Search
CPC ..... E21B 43/16; E21B 43/34; E21B 43/38
See application file for complete search history.

(56) References Cited

U.S. PATENT DOCUMENTS 8,950,491 B2 * 2/2015 Frost ..... E21B 37/06 166/304

* cited by examiner

*Primary Examiner* — Catherine Loikith
(74) *Attorney, Agent, or Firm* — Mark Terry

(57) ABSTRACT

A downhole system for oil production wells includes a tubular cover having a specific length to diameter configuration, the tubular cover including: a first section including 3 groups of 4 perforations equally spaced around the tubular cover; a second section including 3 groups of 4 perforations equally spaced around the tubular cover, wherein the second section is located below the first section, and a third section including 4 groups of 4 perforations equally spaced around the tubular cover, wherein the third section is located below the second section. The system further includes a suction rod having a specific length to diameter configuration based on the tubular cover length to diameter configuration, the suction rod located within the tubular cover, wherein the tubular cover and suction rod are configured for coupling to a suction of a positive displacement pumping device located within production tubing.

20 Claims, 6 Drawing Sheets r
r
r

OIL PRODUCTION WELL GAS SEPARATOR SYSTEM USING PROGRESSIVE PERFORATIONS

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to production of oil and its associated gas and, more specifically, to processes for separating downhole oil from gas during said oil and gas production.

BACKGROUND

In oilfield terminology, a gas-oil separator designates a pressure vessel used for separating well fluids produced from oil and gas wells into gaseous and liquid components. In petroleum production, for example, a gas-oil separator (or simply separator) is a vessel designed to separate production fluids into their constituent components of oil, gas and water. A separating vessel may be referred to in a variety of ways, such as stage separator, flash chamber, etc. Commonly, gas-oil separators are installed as part of the surface facilities. Thus, gas-oil separation typically takes place after the production fluid reaches the surface and leaves the production well.

One apparatus used in oil and associated gas production is a positive displacement pump. Associated gas is a form of natural gas which is found with deposits of petroleum, either dissolved in the oil or as a free gas cap above the oil in the reservoir. A positive displacement pump makes a fluid move by trapping a fixed amount and forcing (displacing) that trapped volume into a discharge channel. Some positive displacement pumps use an expanding cavity on the suction side and a decreasing cavity on the discharge side. Liquid flows into the pump as the cavity on the suction side expands and the liquid flows out of the discharge as the cavity collapses.

A progressive cavity pump is a type of positive displacement pump and is also known as a progressing cavity pump. It transfers fluid by means of the progress, through the pump, of a sequence of discrete cavities, as its rotor is turned. This leads to the volumetric flow rate being proportional to the rotation rate and to low levels of shearing being applied to the pumped fluid. The cavities taper down toward their ends and overlap with adjacent cavities.

Maximum efficiency of the progressing cavity pump occurs when oil is pumped without the presence of associated gas. One of the problems causing pumping efficiency loss in progressive cavity pumps involves the entrance of excess associated gas into the pumping device. In production wells where there is a gas-to-oil ratio above 20 standard cubic feet of gas per standard barrel of oil (GOR), the pumping efficiency of the progressive cavity pump is lowered significantly, thus rendering a low oil production rate.

Therefore, a need exists for improvements over the prior art, and more particularly for methods and systems that increase the pumping efficiency of positive displacement pumps.

SUMMARY

A more efficient downhole oi-gas separation system for an oil production well is provided. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, a downhole gas-oil separator system for an oil production well is provided that solves the above-described problems. The system includes a tubular cover having a specific length to diameter configuration, the tubular cover including: a first section comprising: a first group of 4 perforations equally spaced around the tubular cover, a second group of 4 perforations equally spaced around the tubular cover, wherein the second group is located below the first group, and a third group of 4 perforations equally spaced around the tubular cover, wherein the third group is located below the second group, and wherein the perforations of the first, second and third groups are identical; a second section comprising: a first group of 4 perforations equally spaced around the tubular cover, wherein the first group is located below the third group of the first section, a second group of 4 perforations equally spaced around the tubular cover, wherein the second group is located below the first group, and a third group of 4 perforations equally spaced around the tubular cover, wherein the third group is located below the second group, and wherein the perforation of the first, second and third groups are identical and shorter in one dimension than the perforations of the first section; and a third section comprising: a first group of 4 perforations equally spaced around the tubular cover, wherein the first group is located below the third group of the second section, a second group of 4 perforations equally spaced around the tubular cover, wherein the second group is located below the first group, and a third group of 4 perforations equally spaced around the tubular cover, wherein the third group is located below the second group, and a fourth group of 4 perforations equally spaced around the tubular cover, wherein the fourth group is located below the third group, and wherein the perforations of the first, second, third and fourth groups are identical and shorter in one dimension than the perforations of the second section. The system further includes a suction rod having a specific length to diameter configuration based on the tubular cover length to diameter configuration, the suction rod located within the tubular cover, wherein the tubular cover and suction rod are configured for coupling to a suction of a positive displacement pumping device located within production tubing.

BRIEF DESCRIPTION OF THE DRAWINGS

The accompanying drawings, which are incorporated in and constitute a part of this disclosure, illustrate various example embodiments. In the drawings:

FIG. 6A is a diagram showing various aspects of the operation of the tubular cover of the downhole gas-oil separator system for the oil production well, according to an example embodiment, while

DETAILED DESCRIPTION

Figure 1:
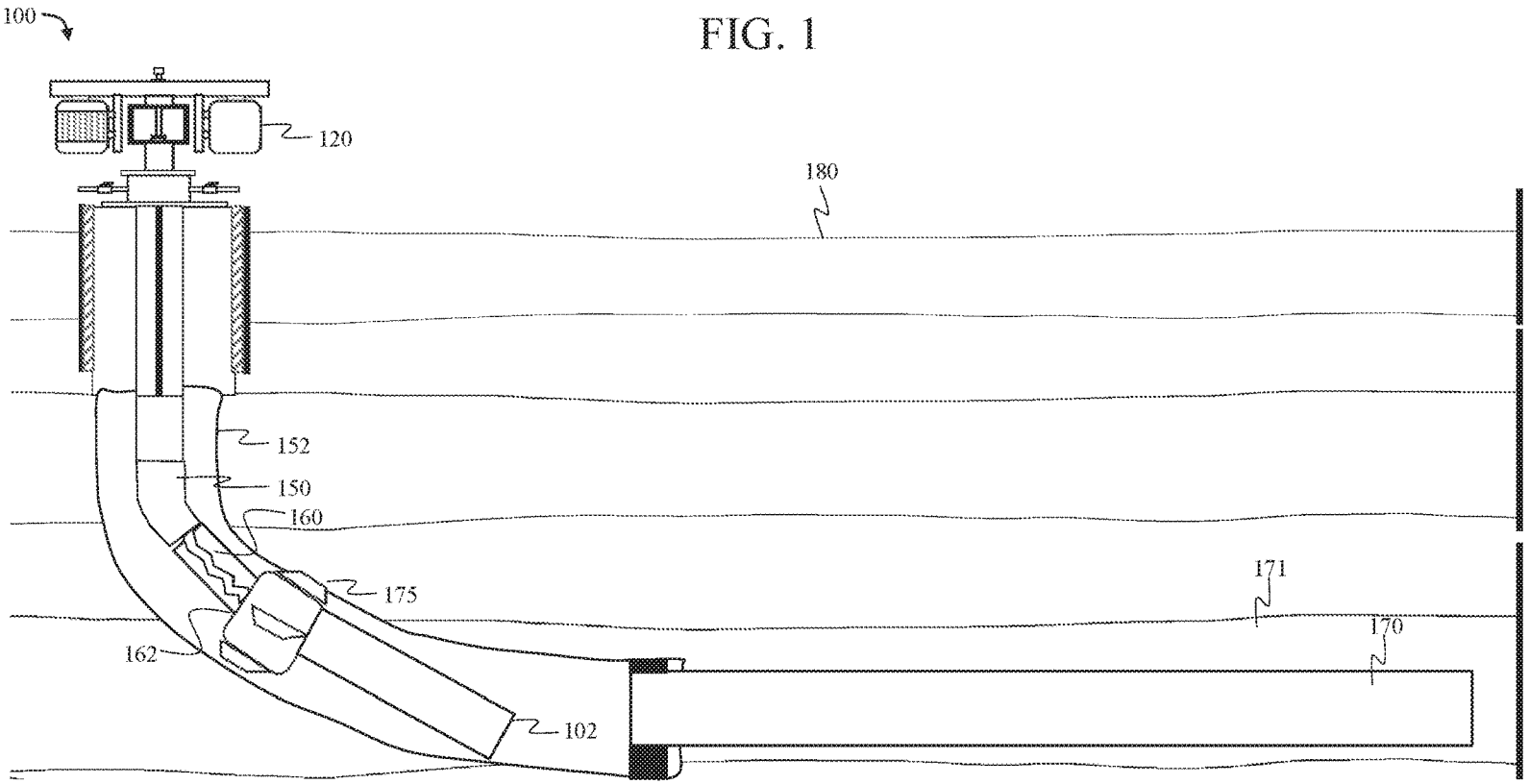
FIG. 1 is a diagram of a downhole gas-oil separator system for an oil production well that solves the above-described problems, according to an example embodiment.
Figure 2B:
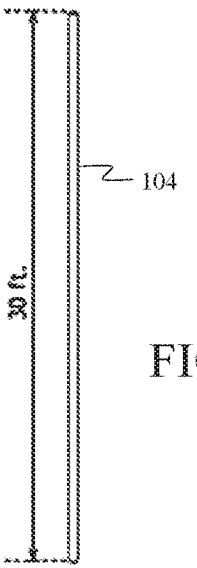
FIG. 2B is a diagram of a suction rod, according to an example embodiment.
Figure 2A:
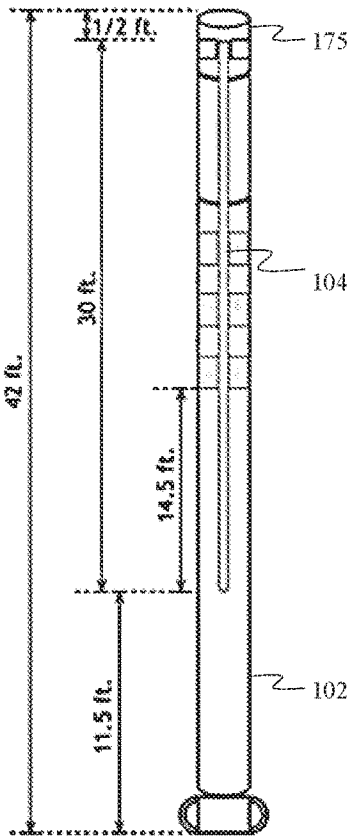
FIG. 2A is a diagram of the main components the downhole gas-oil separator system for an oil production well.

The following detailed description refers to the accompanying drawings. Wherever possible, the same reference numbers are used in the drawings and the following description to refer to the same or similar elements. While embodiments herein may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the claimed subject matter. Instead, the proper scope of the claimed subject matter is defined by the appended claims.

The disclosed embodiments improve over the prior art by providing a downhole system for positive displacement pumps, such as a progressive cavity pump, that increases pumping efficiency by separating the associated gas from the oil at the suction of the pump. This feature increases oil production flow rate, while also reducing the pump maintenance costs and the variable operational costs associated therewith. The disclosed embodiments improve over the prior art by increasing the ability of the oil and associated gas to enter the system in an efficient and well-organized way.

FIG. 1 is a diagram of the complete oil well production arrangement including a progressing cavity pump motor, a progressing cavity pump 160 and a downhole gas-oil separator cover 102, all of these components integrating the gas oil separator system 100, for an oil production well that solves the above-described problems, according to an example embodiment. FIG. 1 shows that the downhole gas-oil separator system 100 for the oil production well includes a production casing 152 including a production tubing 150 situated within the production casing in the ground 180. The wellhead 120 is located above the ground 180. Production casing is a large diameter pipe that is assembled and inserted into a recently drilled section of a borehole and can be held into place with cement. Production tubing is run into the drilled well after the production casing is run and secured in place. Production tubing can protect the production casing from wear, tear, corrosion, and deposition of by-products. Production tubing provides a continuous bore from the production zone to the wellhead 120 through which the underground oil and the associated gas 170 (i.e., crude oil and gas) can be produced above ground.

FIG. 1 shows that a positive displacement pump, such as a progressing cavity pump 160, is attached to the lower end of the production tubing. At the suction end 162 of the progressing cavity pump 160, the tubular cover 102 begins. The tubular cover 102 fits within the production tubing 150 and the production tubing 150 fits within the production casing 152. The tubular cover 102 is located at the suction of the progressing cavity pump 160; both the pump 160 and the tubular separation cover 102 fit within the production tubing 150, while the production tubing 150 fits within the production casing 152.

The progressing cavity pump 160 creates a pressure differential that forces the underground oil and the associated gas 170 (i.e., crude oil and gas) from the reservoir 171 into the production casing 152. A liquid resistance plug or stopper 175 is installed at the top of the tubular cover 102 in order to facilitate the entrance of the crude oil and gas through the perforations in the tubular cover 102. The suction pressure created by the progressing cavity pump 160 forces crude oil and gas to enter through the perforations of the tubular cover 102. The purpose of the stopper 175 is allow gas to pass through the stopper while preventing oil or other fluids from flowing through the stopper.

Certain aspects of the downhole gas-oil separator system 100 will now be described with respect to FIGS. 2A, 2B, 3, 4A, 4B, 4C, 5 and 6A, 6B. The downhole gas-oil separator system 100 includes the tubular cover 102 having a specific length to diameter configuration. The tubular cover 102 may be a tubular shaped element, such as a pipe or a cylinder. In one embodiment, the length of the tubular cover is about 42 feet and the width (or outer diameter) is about 5.5 inches. In another embodiment, the tubular cover 102 has an outer diameter commensurate with an outer diameter of the production tubing 150.

The tubular cover 102 includes three sections, each section including a set of perforations. The first section 402 comprises a first group 422 of 4 perforations equally spaced around the tubular cover, wherein the first group is located about 3 inches from a top of the first section. The first section also comprises a second group 432 of 4 perforations equally spaced around the tubular cover, wherein the second group is located about 3 inches from a lower end of the first group of perforations, and wherein the second group is rotated about 45 degrees (around the tubular cover) with respect to the first group. The first section also comprises a third group 442 of 4 perforations equally spaced around the tubular cover, wherein the third group is located about 3 inches from a lower end of the second group, wherein the third group is lined up with the first group, and wherein each perforation of the first, second and third group measures about 1 inch by about 3 inches (denoted as 412). In this document, a 1st perforation in a cylinder is lined up with a $2^{nd}$ perforation in the cylinder if the line on the cylinder connecting the perforations is parallel to the central axial line of the cylinder. In this document, a 1st set of perforations in a cylinder is lined up with a $2^{nd}$ set of perforations in the cylinder if each perforation in the $1^{st}$ set is lined up with a perforation in the $2^{nd}$ set.

The second section 404 of the tubular cover includes a first group 424 of 4 perforations equally spaced around the tubular cover, wherein the first group of the second section is located about 3 inches below a lower end of the third group of the first section. The second section further comprises a second group 434 of 4 perforations equally spaced around the tubular cover, wherein the second group of the second section is located about 3 inches from a lower end of the first group of the second section, and wherein the second group of the second section is rotated about 45 degrees with respect to the first group of the second section. The second section further comprises a third group 444 of 4 perforations equally spaced around the tubular cover, wherein the third group of the second section is located about 3 inches from a lower end of the second group of the second section, wherein the third group of the second section is lined up with the first group of the second section, and wherein each perforation of the first, second and third group of the second section measures about 1 inch by about 2 inches (denoted as 414).

The third section 406 of the tubular cover comprises a first group 426 of 4 perforations equally spaced around the tubular cover, wherein the first group of the third section is located about 2 inches below a lower end of the third group of the second section. The third section of the tubular cover includes a second group 436 of 4 perforations equally spaced around the tubular cover, wherein the second group of the third section is located about 2 inches from a lower end of the first group of the third section, and, wherein the second group of the third section is rotated about 45 degrees with respect to the first group of the third section. The third section of the tubular cover further comprises a third group 446 of 4 perforations equally spaced around the tubular cover, wherein the third group of the third section is located about 2 inches from a lower end of the second group of the third section, wherein the third group of the third section is rotated about 45 degrees with respect to the second group of the third section. The third section further comprises a fourth group 456 of 4 perforations equally spaced around the tubular cover, wherein the fourth group of the third section is located about 2 inches from a lower end of the third group of the third section, and wherein the fourth group of the third section is rotated about 45 degrees with respect to the third group of the third section, and wherein each perforation of the first, second, and third and fourth group of the third section measures about 1 inch by about 1 inch (denoted as 416).

The downhole gas-oil separator system 100 further includes a suction rod 104 having a specific length to diameter configuration based on the tubular cover length to diameter configuration. The suction rod 104 is located within the tubular cover 102. Also, the tubular cover 102 and suction rod 104 are configured for coupling to a suction 162 of a positive displacement pumping device 160 located within production tubing 150. In one embodiment, the suction rod is about 30 feet long and has an outer diameter of about 2 and three eighths inches. Also, the suction rod may extend about 14 and one half feet below the third section of the tubular cover 102. The purpose of the suction rod 104 is to suck crude oil in its liquid state up through the rod and towards the progressing cavity pump 160, such that the pump 160 may pump said crude oil upwards toward the wellhead.

In one embodiment, one, some or all of the perforations of the first, second and/or third sections of the tubular cover 102 have rounded corners. Any grouping or combination of the perforations of the first, second and/or third sections of the tubular cover 102 may have rounded corners, while others may not.

In another embodiment, the production casing 152 is about 13⅜ inches in diameter. The production tubing 150 is about 5½ inches in diameter and fits within the production casing. The tubular cover 102 may also be about 5½ inches in diameter where the perforations are located. The progressing cavity pump 160 is conveniently located in the lower level of the production tubing 150 and may also be about 5½ inches in diameter. The production casing and the production tubing 152 are extended into the oil reservoir 171 and both have a different pattern of perforations to allow the crude oil and its associated gas to enter from the reservoir into the production tubing. The progressing cavity pump 160 creates the pressure differential that forces the crude oil fluids from the reservoir into the production casing and into the production tubing. As shown in FIGS. 1, 2A, 2B and 3, a liquid resistance plug 175 is installed at the top of the tubular cover 102 in order to facilitate the entrance of the crude oil and gas through the perforations in the tubular cover. The suction pressure created by the progressive cavity pump 160 forces all liquid and gas to enter through the holes of the tubular cover 102.

Figure 3:
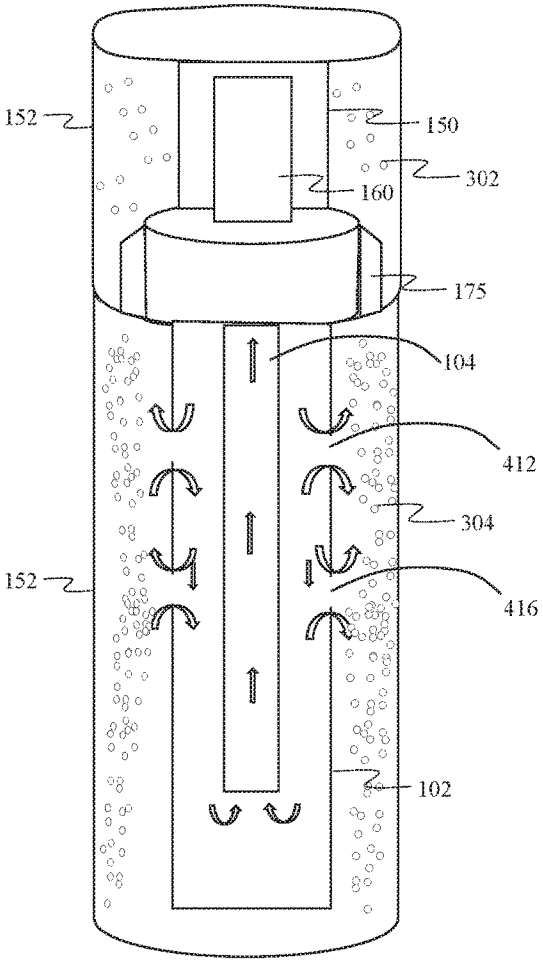
FIG. 3 is a diagram showing a close-up of certain components of the downhole gas-oil separator system for the oil production well, according to an example embodiment.
Figure 4:
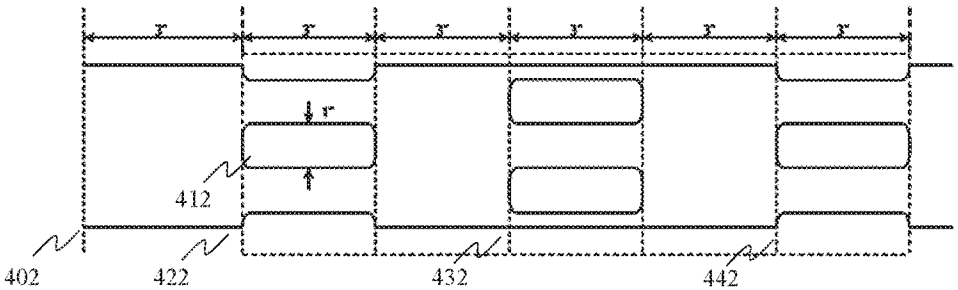
FIGS. 4A, 4B and 4C are diagrams showing close-ups of the sections of the tubular cover of the downhole gas-oil separator system for the oil production well, according to an example embodiment.
Figure 5:
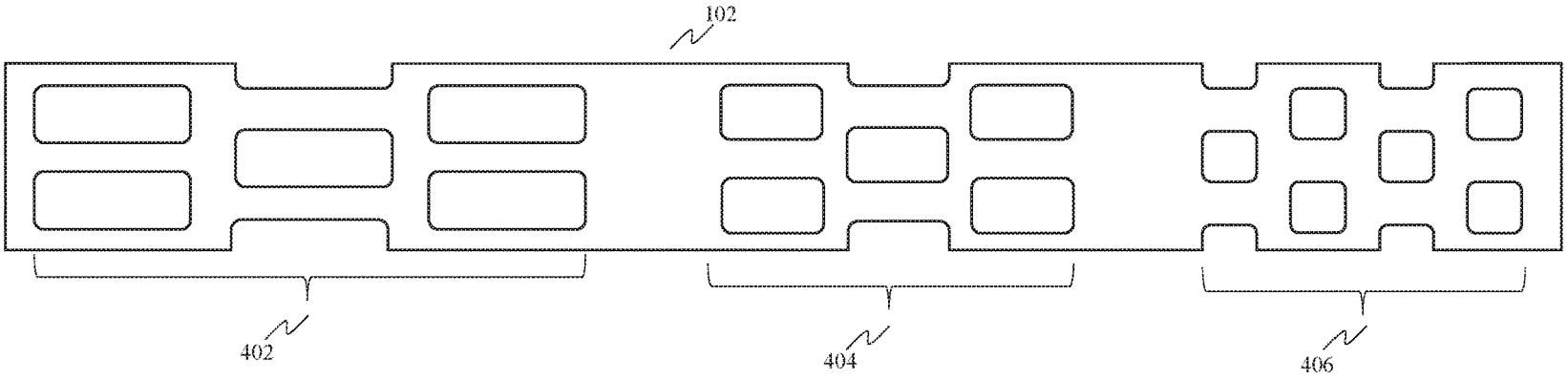
FIG. 5 is a diagram showing a side view of the tubular cover of the downhole gas-oil separator system for the oil production well, according to an example embodiment.

FIG. 3 is a diagram showing a close-up of certain components of the downhole gas-oil separator system 100 for the oil production well, according to an example embodiment. As explained above, the suction rod 104 may extend about 14.5 feet below the perforations of the tubular cover 102. Part of the crude oil and gas present in the production casing 152 are forced to enter through the perforations of the third section 406 of the tubular cover 102. This section holds the smallest one inch by one inch perforations (416). Here, most of the liquid enters and the gas continues its path upwards through the production casing 152. The pump 160 pushes down the crude oil to the suction rod 104 while a small amount of gas bubbles collapse into larger bubbles and move upward to the second section 404 of the gas separator tube. This section holds one inch by two inch perforations (414) allowing the entrance of crude oil (into cover 102) and allowing the exit of larger gas bubbles (out of cover 102). Separated gas within the production casing 152 and below the stopper 175 is indicated as circles 304 in FIG. 3.

Finally, all gas that has entered the tubular cover 102 travels out to the production casing 152 through the first section 402 of the tubular cover 102 where the largest one inch by three inch perforations (412) are located, and where the fluid velocity is low and allows the density difference forces to separate all remaining gas. Subsequently, the separated gas flows upwards through the stopper 175 but within the production casing 152, while the crude oil is sucked upwards via the suction rod 104. Separated gas within the production casing 152 and above the stopper 175 is indicated as circles 302 in FIG. 3. The gas-oil separation system 100 works on the following principles: 1) there is a large density difference between gas and crude oil and 2) there is a suction force and oil acceleration that is experienced due to the reduced diameter suction rod.

Figure 6B:
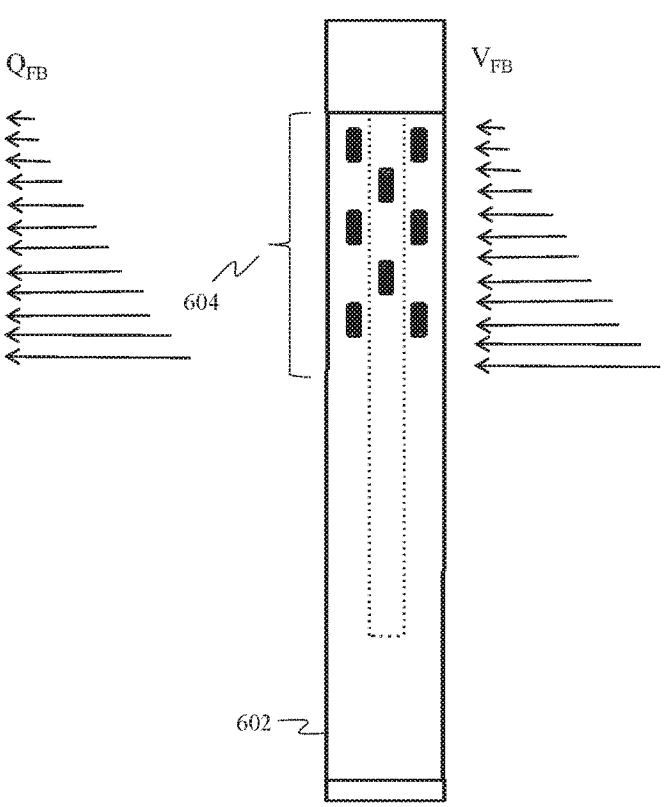
FIG. 6B is a diagram showing various aspects of the operation of another tubular cover with perforations of the same size.
Figure 6A:
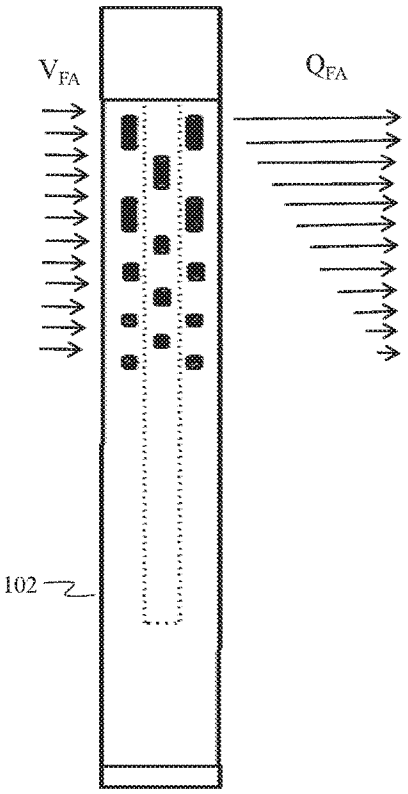

FIG. 6A is a diagram showing various aspects of the operation of the tubular cover 102 of the downhole gas-oil separator system 100 for the oil production well, according to an example embodiment. The arrows in FIG. 6A represent magnitude. FIG. 6A shows that the experimentally developed and field proven perforation pattern on the tubular cover 102, causes a constant oil velocity intake $V_{FA}$ through the different perforated sections of the tubular cover 406, 404 and 402, while ensuring an increasing exit volumetric flow of gas $Q_{FA}$—as the gas bubbles that could have entered the third section (406) and second section (404) are separated by the large density gradient between the oil and gas, the increasing size of gas bubbles, formed within the tubular cover (102), are allowed to exit faster through the larger perforations of the first and second sections (404, 402), as the gas moves up the perforated tubular cover 102. This combination of constant velocity fluid $V_{FA}$ but increasing gas volumetric flow $Q_{FA}$ up the tubular cover 102 is fundamental to the separation efficiency of the oil gas separator.

Recall the arrows in FIG. 6A represent magnitude. FIG. 6A shows that the volumetric flow rate $Q_{FA}$ due to tubular cover 102 increases as the perforations get larger (going upwards). FIG. 6A also shows that the velocity of the flow $V_{FA}$ in sections is constant as the perforations get larger (going upwards). The constant velocity of the flow $V_{FA}$ in the tubular cover 604 increases efficiency of the system.

In a hypothetical tubular cover 602 with perforations of the same size 604, FIG. 6B shows that the volumetric flow rate $Q_{FB}$ in the tubular cover 602 increases as one moves downwards along the cover. FIG. 6B also shows that the velocity of the flow $V_{FB}$ in the tubular cover 602 increases as one moves downwards along the cover. The variable (non-constant) velocity of the flow $V_{FB}$ in the tubular cover 602 decreases efficiency of the system. This illustrates the reason for the varying size in perforations in Applicant's claimed subject matter.

Embodiments herein, for example, are described above with reference to block diagrams and/or operational illustrations of methods, systems, and processes. While certain embodiments have been described, other embodiments may exist. Further, the disclosed processes may be modified in any manner, including by reordering stages and/or inserting or deleting stages, without departing from the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A downhole gas-oil separator system for oil production wells, comprising:

1) a tubular cover having a specific length to diameter configuration, the tubular cover including:

a) a first section comprising: i) a first group of 4 perforations equally spaced around the tubular cover, wherein the first group is located 3 inches from a top of the first section, ii) a second group of 4 perforations equally spaced around the tubular cover, wherein the second group is located 3 inches from a lower end of the first group of perforations, and wherein the second group is rotated 45 degrees with respect to the first group, and iii) a third group of 4 perforations equally spaced around the tubular cover, wherein the third group is located 3 inches from a lower end of the second group, wherein the third group is lined up with the first group, and wherein each perforation of the first, second and third group measures 1 inch by 3 inches;

b) a second section comprising: i) a first group of 4 perforations equally spaced around the tubular cover, wherein the first group of the second section is located 3 inches below a lower end of the third group of the first section, ii) a second group of 4 perforations equally spaced around the tubular cover, wherein the second group of the second section is located 3 inches from a lower end of the first group of the second section, and wherein the second group of the second section is rotated 45 degrees with respect to the first group of the second section, and iii) a third group of 4 perforations equally spaced around the tubular cover, wherein the third group of the second section is located 3 inches from a lower end of the second group of the second section, wherein the third group of the second section is lined up with the first group of the second section, and wherein each perforation of the first, second and third group of the second section measures 1 inch by 2 inches; and c) a third section comprising: i) a first group of 4 perforations equally spaced around the tubular cover, wherein the first group of the third section is located 2 inches below a lower end of the third group of the second section, ii) a second group of 4 perforations equally spaced around the tubular cover, wherein the second group of the third section is located 2 inches from a lower end of the first group of the third section, and, wherein the second group of the third section is rotated 45 degrees with respect to the first group of the third section, and iii) a third group of 4 perforations equally spaced around the tubular cover, wherein the third group of the third section is located 2 inches from a lower end of the second group of the third section, wherein the third group of the third section is rotated 45 degrees with respect to the second group of the third section, and iv) a fourth group of 4 perforations equally spaced around the tubular cover, wherein the fourth group of the third section is located 2 inches from a lower end of the third group of the third section, and wherein the fourth group of the third section is rotated 45 degrees with respect to the third group of the third section, and wherein each perforation of the first, second, and third and fourth group of the third section measures 1 inch by 1 inch; and 2) a suction rod having a specific length to diameter configuration based on the tubular cover length to diameter configuration, the suction rod located within the tubular cover, wherein the tubular cover and suction rod are configured for coupling to a suction of a positive displacement pumping device located within production tubing.

2. The system of claim 1, wherein the perforations of the first, second and third groups of the first section include rounded corners.

3. The system of claim 2, wherein the perforations of the first, second and third groups of the second section include rounded corners.

4. The system of claim 3, wherein the perforations of the first, second, third and fourth groups of the third section include rounded corners.

5. The system of claim 1, wherein the tubular cover has an outer diameter of about 5 and one half inches.

6. The system of claim 5, wherein the tubular cover is about 42 feet long.

7. The system of claim 6, wherein the suction rod is about 30 feet long.

8. The system of claim 7, wherein the suction rod has an outer diameter of about 2 and three eighths inches.

9. The system of claim 8, wherein the suction rod extends about 14 and one half feet below the third section of the tubular cover.

10. The system of claim 1, wherein the tubular cover has an outer diameter commensurate with an outer diameter of the production tubing.

11. A downhole gas-oil separator system for oil production wells, comprising:

1) a tubular cover having a specific length to diameter configuration, the tubular cover including:
   a) a first section comprising: i) a first group of 4 perforations equally spaced around the tubular cover, ii) a second group of 4 perforations equally spaced around the tubular cover, wherein the second group is located below the first group, and iii) a third group of 4 perforations equally spaced around the tubular cover, wherein the third group is located below the second group, and wherein each perforation of the first, second and third group measures 1 inch by 3 inches;
   b) a second section comprising: i) a first group of 4 perforations equally spaced around the tubular cover, wherein the first group of the second section is located below the third group of the first section, ii) a second group of 4 perforations equally spaced around the tubular cover, wherein the second group is located below the first group of the second section, and iii) a third group of 4 perforations equally spaced around the tubular cover, wherein the third group of the second section is located below the second group of the second section, and wherein each perforation of the first, second and third group of the second section measures 1 inch by 2 inches; and
   c) a third section comprising: i) a first group of 4 perforations equally spaced around the tubular cover, wherein the first group of the third section is located below the third group of the second section, ii) a second group of 4 perforations equally spaced around the tubular cover, wherein the second group of the third section is located below the first group of the third section, iii) a third group of 4 perforations equally spaced around the tubular cover, wherein the third group of the third section is located below the second group of the third section, and iv) a fourth group of 4 perforations equally spaced around the tubular cover, wherein the fourth group of the third section is located below the third group of the third section, and wherein each perforation of the first, second, third and fourth group of the third section measures 1 inch by 1 inch; and
2) a suction rod having a specific length to diameter configuration based on the tubular cover length to diameter configuration, the suction rod located within the tubular cover, wherein the tubular cover and suction rod are configured for coupling to a suction of a positive displacement pumping device located within production tubing.

12. The system of claim 11, wherein the perforations of the first, second and third groups of the first section include rounded corners.

13. The system of claim 12, wherein the perforations of the first, second and third groups of the second section include rounded corners.

14. The system of claim 13, wherein the perforations of the first, second, third and fourth groups of the third section include rounded corners.

15. The system of claim 11, wherein the tubular cover has an outer diameter of about 5 and one half inches.

16. The system of claim 15, wherein the tubular cover is about 42 feet long.

17. The system of claim 16, wherein the suction rod is about 30 feet long.

18. The system of claim 17, wherein the suction rod has an outer diameter of about 2 and three eighths inches.

19. The system of claim 18, wherein the suction rod extends about 14 and one half feet below the third section of the tubular cover.

20. A downhole gas-oil separator system for oil production wells, comprising:
1) a tubular cover having a specific length to diameter configuration, the tubular cover including:
   a) a first section comprising: i) a first group of 4 perforations equally spaced around the tubular cover, ii) a second group of 4 perforations equally spaced around the tubular cover, wherein the second group is located below the first group, and iii) a third group of 4 perforations equally spaced around the tubular cover, wherein the third group is located below the second group, and wherein the perforations of the first, second and third groups are identical;
   b) a second section comprising: i) a first group of 4 perforations equally spaced around the tubular cover, wherein the first group of the second section is located below the third group of the first section, ii) a second group of 4 perforations equally spaced around the tubular cover, wherein the second group of the second section is located below the first group of the second section, and iii) a third group of 4 perforations equally spaced around the tubular cover, wherein the third group of the second section is located below the second group of the second section, and wherein the perforation of the first, second and third groups of the second section are shorter in one dimension than the perforations of the first section; and
   c) a third section comprising: i) a first group of 4 perforations equally spaced around the tubular cover, wherein the first group of the third section is located below the third group of the second section, ii) a second group of 4 perforations equally spaced around the tubular cover, wherein the second group of the third section is located below the first group of the third section, iii) a third group of 4 perforations equally spaced around the tubular cover, wherein the third group of the third section is located below the second group of the third section, and iv) a fourth group of 4 perforations equally spaced around the tubular cover, wherein the fourth group of the third section is located below the third group of the third section, and wherein the perforations of the first, second, third and fourth groups of the third section are shorter in one dimension than the perforations of the second section; and
2) a suction rod having a specific length to diameter configuration based on the tubular cover length to diameter configuration, the suction rod located within the tubular cover, wherein the tubular cover and suction rod are configured for coupling to a suction of a positive displacement pumping device located within production tubing.

* * * * *